United States Patent [19]

Thönes

[11] Patent Number: 4,694,897

[45] Date of Patent: Sep. 22, 1987

[54] HEAT EXCHANGER FOR HEAT EXCHANGE BETWEEN HOT GAS AND MEDIUM FLOWING THROUGH TUBE BUNDLES

[75] Inventor: Gustav Thönes, Gummersbach, Fed. Rep. of Germany

[73] Assignee: L. & C. Steinmüller GmbH, Gummersbach, Fed. Rep. of Germany

[21] Appl. No.: 897,379

[22] Filed: Aug. 18, 1986

[30] Foreign Application Priority Data

Aug. 19, 1985 [DE] Fed. Rep. of Germany ..... 3529634

[51] Int. Cl.[4] ..... F28F 9/22

[52] U.S. Cl. ..... 165/160; 165/161; 122/32; 376/391

[58] Field of Search ..... 165/160, 161; 122/32; 376/391, 392

[56] References Cited

U.S. PATENT DOCUMENTS

| | | | |
|---|---|---|---|
| 2,468,903 | 5/1949 | Villiger | 165/160 X |
| 3,749,160 | 7/1973 | Vestre | 165/160 X |
| 4,220,200 | 9/1980 | Weber | 376/391 X |
| 4,285,393 | 8/1981 | Mans et al. | 165/160 X |
| 4,366,854 | 1/1983 | Artand et al. | 122/32 X |
| 4,552,211 | 11/1985 | Weber | 165/160 |

FOREIGN PATENT DOCUMENTS

| | | | |
|---|---|---|---|
| 0035450 | 9/1981 | European Pat. Off. | 165/160 |
| 717495 | 2/1942 | Fed. Rep. of Germany | 165/160 |
| 2308317 | 8/1973 | Fed. Rep. of Germany | 165/160 |
| 3421746 | 12/1985 | Fed. Rep. of Germany | 165/161 |
| 426731 | 11/1947 | Italy | 165/160 |

*Primary Examiner*—Albert W. Davis, Jr.
*Assistant Examiner*—Randolph A. Smith
*Attorney, Agent, or Firm*—Becker & Becker, Inc.

[57] ABSTRACT

A heat exchanger for heat exchange between a hot gas and a flowing medium that is conveyed in tube bundle heat transfer surfaces, especially a steam generator. The heat exchanger includes a pressure tank, the heat exchanger vessel in which are disposed tube bundles, and a hot gas conduit that is connected with a gas inlet of the heat exchanger wall. Also included are a gas guidance tube, a gas outlet to a circulation fan, and inlets and outlets for the flowing medium. The gas guiding tube opens into the heat exchanger from the side, and an annular channel is disposed after the gas inlet in the heat exchanger wall. The annular channel is delimited inwardly by a riser that forms the gas outlet and is disposed concentrically relative to the walls of the pressure tank and the heat exchanger. The gas from this annular chamber enters the tube bundles and, after being deflected, enters the riser that leads to the circulation fan. The riser extends from the annular chamber in the direction of the tube bundles to the outlet ends of the latter.

4 Claims, 1 Drawing Figure

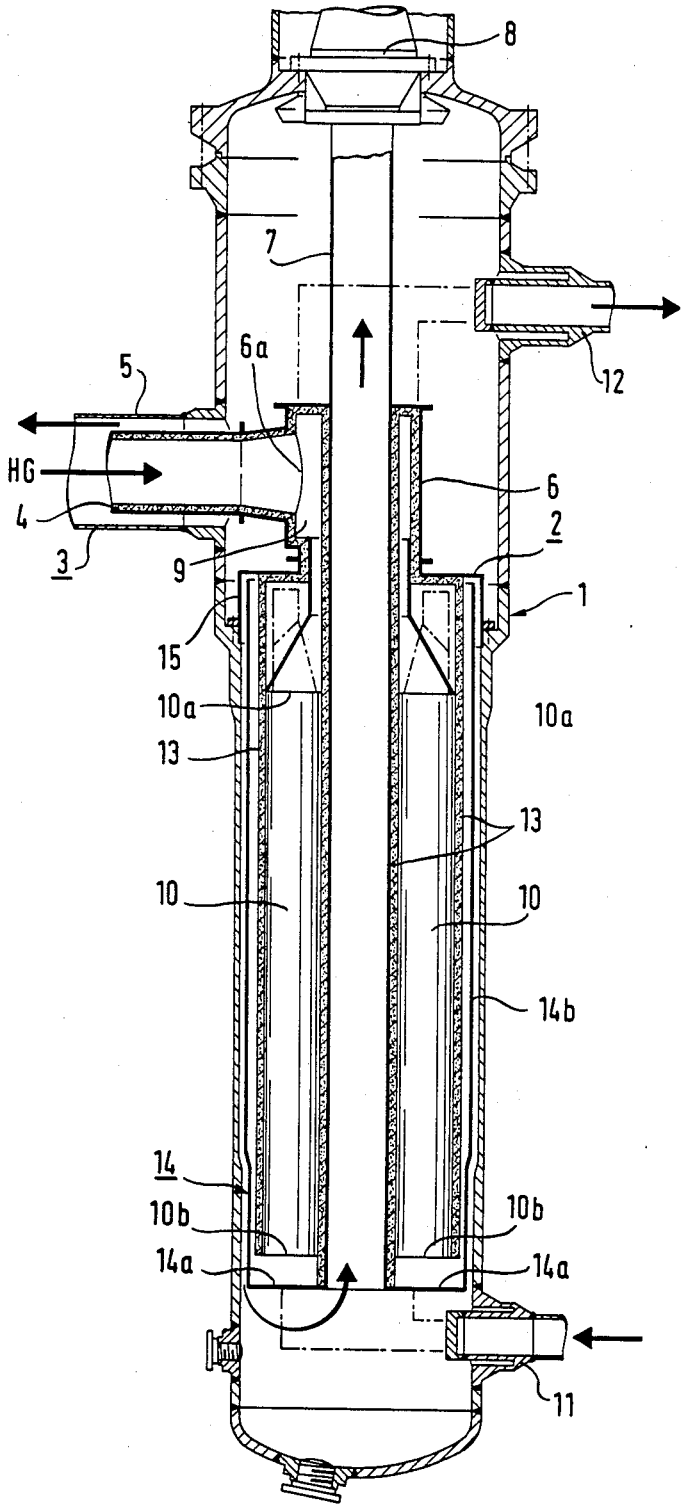
8
7
6a
5
12
HG
6
4
2
3
9
1
15
10a
10a
13
13
10
10
14b
14
10b
10b
14a
14a
11

HEAT EXCHANGER FOR HEAT EXCHANGE BETWEEN HOT GAS AND MEDIUM FLOWING THROUGH TUBE BUNDLES

BACKGROUND OF THE INVENTION

1. Field of the Invention

The present invention relates to a heat exchanger for the heat exchange between a hot gas and a flowing medium that is conveyed in tube bundle heat transfer surfaces, especially a steam generator for gas-cooled high-temperature reactors. Included is a pressure tank, a heat exchanger vessel in which are disposed the tube bundles, a hot gas conduit that is connected to a gas inlet on one end of the wall of the heat exchanger. Also included are a gas guiding tube, a gas outlet from the heat exchanger vessel to a circulation fan, and feed and withdrawal lines for the flowing medium that is to be heated up. As the hot gas flows into the heat exchanger, it is essentially deflected by 90°.

2. Description of the Prior Art

A heat exchanger of this general type is known from Dubbel "Taschenbuch fü den Maschinenbau", 15th edition (1983), Pages 588 and 601, 602.

In copending patent application Ser. No. 868,242 Pallark filed May 28, 1986, and belonging to the Assignee of the present application, a heat exchanger includes a gas guiding tube for the hot gas conduit opened into the wall of the heat exchanger from the side. An annular channel is disposed after the gas inlet in the heat exchanger wall, with this annular channel being delimited inwardly by a riser that forms the gas outlet to the circulation fan and is disposed concentric to the walls of the pressure tank and the heat exchanger. In this heat exchanger, the gas enters the tube bundles from the annular chamber and exits the tube bundle accompanied by a deflection of essentially 180°, whereupon the gas is supplied to the circulation fan via the riser. With this arrangement, the gas in the annular chamber flows between the heat exchanger, especially a steam generator wall, and the wall of the pressure tank in the direction toward the 90° deflection, and is previously introduced into the riser through a plurality of gas channels that extend through the upper end of the steam generator wall; the gas is fed from there to the circulation fan, with the riser being disposed in that portion of the hot gas deflection mechanism that extends parallel to the axis of the tank and effects the 90° deflection.

With the initially described arrangement, as well as with the arrangement disclosed in the aforementioned copending U.S. patent application, the heat transfer surfaces of the steam generator are disposed about a dead space.

An object of the present invention is to design a heat exchanger of the type described in the aforementioned patent application in such a way that the gas that leaves the tube heat transfer surfaces is supplied to the circulation pump in as simple a manner as possible, and in particular that gas channels are avoided that would have to extend through the wall of the steam generator as well as through the compensation tube bundles associated with the upper end of the steam generator wall.

BRIEF DESCRIPTION OF THE DRAWING

This object, and other objects and advantages of the present invention, will appear more clearly from the following specification in conjunction with the accompanying schematic drawing. The drawing illustrates a cross-sectional view through a steam generator such as is used to generate steam in conjunction with gas-cooled thermal reactors.

SUMMARY OF THE INVENTION

The heat exchanger of the present invention is characterized primarily in that the riser extends from the hot gas guide means that forms the annular channel to the outlet end of the tube bundles.

As a consequence of this inventive arrangement, the gas that exits the tube bundles can be supplied via a central flow to the circulation fan without the requirement for gas guiding channels that extend through the heat exchanger. This feed is effected by utilizing the dead space that exists in the center of the tube bundles.

It is expedient to deflect the gas that leaves the tube bundles via a gas deflection means in such a way that the gas first flows along the surface of the heat exchanger wall in the direction toward the inlet end of the tube bundles. The gas is then again deflected and flows along the inner wall of the pressure tank wall in the direction toward the inlet end of the riser. The operational reliability of the heat exchanger is improved by the arrangement of such a deflection or baffle means. A hot gas stream that leaves or escapes the wall of the heat exchanger cannot directly strike the inner wall of the steam generator, but rather must first strike the flow-deflection means. Furthermore, the preferred flow guidance assures that the pressure tank is provided with a uniform operating temperature in the region of the heat exchanger. The heat exchanger is preferably disposed vertically.

DESCRIPTION OF PREFERRED EMBODIMENTS

Referring now to the drawing in detail, a heat exchanger vessel 2 is disposed in a pressure tank 1. To supply the steam generator, cooling gas, for example helium, which has been heated in a high-temperature reactor, is delivered via a coaxial line 3. The latter is formed by an internal gas guiding tube 4, and an external conduit 5 that is welded to the pressure tank 1. The coaxial line 3 comes from the side and thus extends horizontally if the steam generator is disposed vertically. Associated with the coaxial line 3, in the wall 6 of the steam generator, is a gas inlet opening 6*a*. A riser 7 extends through the center of the heat exchanger 2 and the pressure tank 1. The riser 7 connects the lower end of the heat exchanger 2 with the inlet end 8 of a non-illustrated circulation fan. In the region of the inlet opening 6*a*, the wall 6 of the heat exchanger, together with the outer wall of the riser 7, defines an annular channel 9 into which the hot gas HG flows via the gas inlet opening 6*a*.

The tube heat transfer surfaces 10 to which the hot gas is to be supplied are disposed within the wall 6 of the heat exchanger around the riser 7. The lower end of the tube heat transfer surfaces 10 is connected with a feed water inlet 11, whereas the upper end is connected with a hot steam outlet 12. These connections are illustrated schematically in the drawing via dot-dash lines. Insulation 13 is indicated via cross hatching.

A gas guidance or deflection means 14 is connected to the lower end of the riser. This deflection means comprises a base 14*a*, and a wall 14*b* that extends in the annular gap between the wall 6 of the heat exchanger 2 and the inner wall of the pressure tank 1. A cover or hood 15 is spaced from the free end of the wall 14*b*. The hood 15 is connected in an airtight manner not only to the heat exchanger 2 but also to the pressure tank 1. As can be seen from the drawing, the heat exchanger is preferably suspended in the pressure tank via this hood 15. The gas that enters the tube bundles 10 via the gas inlet end 10*a* leaves the tube bundles at the gas outlet end 10*b* and is guided or deflected by the base 14*a* into the annular gap between the heat exchanger wall 6 and the wall 14*b* of the deflection means 14.

The gas is then deflected by the hood 15, so that the gas flows downwardly between the outer side of the wall 14*b* and the inner surface of the tank 1, from where cold gas KG can enter the lower end of the riser 7.

If the wall 6 of the heat exchanger becomes perforated in the region of the heat transfer surfaces, the escaping stream of hot gas strikes the guide wall If the wall 6 of the heat exchanger becomes perforated in the region of the heat transfer surfaces, the escaping stream of hot gas strikes the guide wall 14*b*, and does not strike the pressure tank 1.

The present invention is, of course, in no way restricted to the specific disclosure of the specification and drawings, but also encompasses any modifications within the scope of the appended claims.

What I claim is:

1. A heat exchanger for the heat exchange between a hot gas and a flowing medium that is conveyed in tube bundle heat transfer surfaces, comprising:

a pressure tank having a wall and connecting means for gas circulation;

a heat exchanger vessel disposed in said pressure tank, with said heat exchanger vessel having a wall, gas inlet means, and gas outlet means;

tube bundles disposed within said wall of said heat exchanger vessel and having said heat transfer surfaces for receiving hot gas from said gas inlet means of said heat exchanger vessel and said pressure tank, with said tube bundles also having inlet and outlet means for said flowing medium and gas outlet means for gas leaving said tube bundles;

hot gas conduit means that communicate with said gas inlet means of said heat exchanger vessel, with said hot gas conduit means opening into said heat exchanger vessel wall from the side, with an annular chamber being disposed within said vessel wall between said gas inlet means of said vessel and said tube bundles;

gas deflection means disposed downstream from said gas outlet means of said tube bundles for deflecting the direction of flow of gas in such a way that gas leaving said tube bundles via said gas outlet means thereof first flows along the outer surface of said wall of said heat exchanger vessel in the direction toward said gas inlet means of said vessel, and then flows in the opposite direction along the inner surface of said wall of said pressure tank in the direction toward said gas outlet means of said tube bundles;

a riser disposed in said heat exchanger vessel, concentric to said walls of said pressure tank and said vessel, to provide communication by being twofold deflected by said gas deflection means and via said gas circulation connecting means, with said riser providing an inward delimitation for said annular chamber, and with said riser extending from said gas circulation connecting means, in the direction of said tube bundles, to the vicinity of said gas outlet means of of said tube bundles; and said gas deflection means essentially provide for a 180° deflection of gas between said gas outlet means of said tube bundles and said riser.

2. A heat exchanger for the heat exchange between a hot gas and a flowing medium that is conveyed in tube bundle heat transfer surfaces, comprising:

a pressure tank having a wall;

a heat exchanger vessel disposed in said pressure tank, with said heat exchanger vessel having a wall, gas inlet means, and gas outlet means;

tube bundles disposed within said wall of said heat exchanger vessel and having said heat transfer surfaces for receiving hot gas from said gas inlet means of said heat exchanger vessel and said pressure tank, with said tube bundles also having inlet and outlet means for said flowing medium and gas outlet means for gas leaving said tube bundles;

hot gas conduit means that communicate with said gas inlet means of said heat exchanger vessel, with said hot gas conduit means opening into said heat exchanger vessel wall from the side, with an annular chamber being disposed within said vessel wall between said gas inlet means of said vessel and said tube bundles;

gas deflection means disposed between said gas outlet means of said tube bundles and said gas outlet means of said heat exchanger vessel for deflecting the direction of flow of gas as it travels from the former to the latter; and a riser disposed in said heat exchanger vessel, conventric to said walls of said pressure tank and said vessel, to provide communication between said gas outlet means of said vessel and a circulation fan, with said riser providing an inward delimitation for said annular chamber, and with said rise extending at least from the vicinity of said annular chamber, in the direction of said tube bundles, to the vicinity of said gas outlet means of said tube bundles; said gas deflection means essentially providing for a 180° deflection of gas between said gas outlet means of said tube bundles and said gas outlet means of said heat exchanger vessel;

said gas deflection means being embodied to provide deflection in such a way that gas leaving said tube bundles via said gas outlet means thereof first flows along the outer surface of said wall of said heat exchanger vessel in the direction toward said gas inlet means of said vessel, and then flows in the opposite direction along the inner surface of said wall of said pressure tank in the direction toward said gas outlet means of said heat exchanger vessel.

3. A heat exchanger according to claim 2, which is disposed vertically.

4. A heat exchanger according to claim 3, in which said riser is centrally disposed within said heat exchanger vessel and in said pressure tank.

* * * * *